US010707012B2

(12) United States Patent
Jeong et al.

(10) Patent No.: US 10,707,012 B2
(45) Date of Patent: Jul. 7, 2020

(54) CHIP ELECTRONIC COMPONENT

(71) Applicant: SAMSUNG ELECTRO-MECHANICS CO., LTD., Suwon-si (KR)

(72) Inventors: Jong Suk Jeong, Suwon-si (KR); Kang Heon Hur, Suwon-si (KR); Seong Jae Lee, Suwon-si (KR); Jung Wook Seo, Suwon-si (KR); Hiroyuki Matsumoto, Suwon-si (KR); Chul Min Sim, Suwon-si (KR); Jong Sik Yoon, Suwon-si (KR)

(73) Assignee: SAMSUNG ELECTRO-MECHANICS CO., LTD., Suwon-si, Gyeonngi-do (KR)

( * ) Notice: Subject to any disclaimer, the term of this patent is extended or adjusted under 35 U.S.C. 154(b) by 415 days.

(21) Appl. No.: 14/961,414

(22) Filed: Dec. 7, 2015

(65) Prior Publication Data

US 2016/0172098 A1 Jun. 16, 2016

(30) Foreign Application Priority Data

Dec. 10, 2014 (KR) ..... 10-2014-0177855

(51) Int. Cl.
*H01F 5/00* (2006.01)
*H01F 27/36* (2006.01)
*H01F 17/00* (2006.01)

(52) U.S. Cl.
CPC ..... *H01F 27/365* (2013.01); *H01F 17/0013* (2013.01); *H01F 2017/0066* (2013.01)

(58) Field of Classification Search
USPC ..... 336/200
See application file for complete search history.

(56) References Cited

U.S. PATENT DOCUMENTS

| | | | | |
|---|---|---|---|---|
| 6,392,525 | B1 | 5/2002 | Kato et al. | |
| 6,768,409 | B2 | 7/2004 | Inoue et al. | |
| 7,212,094 | B2 | 5/2007 | Matsutani et al. | |
| 8,378,777 | B2 * | 2/2013 | Yan | H01F 17/0013 336/192 |
| 9,252,611 | B2 | 2/2016 | Lee et al. | |

(Continued)

FOREIGN PATENT DOCUMENTS

| | | | |
|---|---|---|---|
| CN | 1685452 | A | 10/2005 |
| CN | 1266712 | C | 7/2006 |

(Continued)

OTHER PUBLICATIONS

First Office Action dated May 3, 2017, in Chinese Patent Application No. 201510917250.6, with English language translation.

(Continued)

*Primary Examiner* — Ronald Hinson
(74) *Attorney, Agent, or Firm* — Morgan, Lewis & Bockius LLP

(57) ABSTRACT

A chip electronic component includes a magnetic body including magnetic metal powder particles, an internal coil unit embedded in the magnetic body, and a cover unit disposed on at least one of upper and lower surfaces of the magnetic body and including a magnetic metal plate. The magnetic metal plate is cracked and includes a plurality of metal fragments.

32 Claims, 11 Drawing Sheets

(56) References Cited

U.S. PATENT DOCUMENTS

| | | | | |
|---|---|---|---|---|
| 9,504,194 | B2 | 11/2016 | Lee et al. | |
| 2003/0048167 | A1* | 3/2003 | Inoue | H01F 17/0013 336/200 |
| 2005/0068150 | A1 | 3/2005 | Matsutani et al. | |
| 2013/0249664 | A1* | 9/2013 | Tonoyama | H01F 41/04 336/200 |
| 2014/0167897 | A1 | 6/2014 | Choi et al. | |
| 2014/0266543 | A1 | 9/2014 | Park et al. | |
| 2015/0123604 | A1* | 5/2015 | Lee | H01F 38/14 320/108 |
| 2016/0081237 | A1 | 3/2016 | Lee et al. | |
| 2016/0081238 | A1 | 3/2016 | Lee et al. | |
| 2016/0081239 | A1 | 3/2016 | Lee et al. | |
| 2016/0081240 | A1 | 3/2016 | Lee et al. | |
| 2017/0263370 | A1* | 9/2017 | Park | H01F 27/255 |

FOREIGN PATENT DOCUMENTS

| | | | |
|---|---|---|---|
| CN | 104011814 | A | 8/2014 |
| EP | 2797092 | A1 | 10/2014 |
| JP | 9-270334 | A | 10/1997 |
| JP | 2001-185421 | A | 7/2001 |
| JP | 3-284808 | A | 5/2002 |
| JP | 2003-203813 | A | 7/2003 |
| JP | 2005-317604 | A | 11/2005 |
| JP | 3807438 | B2 | 8/2006 |
| JP | 2008-112830 | A | 5/2008 |
| JP | 2008166455 | A | 7/2008 |
| JP | 2013-055232 | A | 3/2013 |
| JP | 2014-183307 | A | 9/2014 |
| KR | 10-2013-0109776 | A | 10/2013 |
| KR | 10-2014-0077346 | A | 6/2014 |
| WO | 2013/095036 | A1 | 6/2013 |

OTHER PUBLICATIONS

Second Office Action dated Nov. 29, 2017, in Chinese Patent Application No. 201510917250.6 (with full English language translation).

Chinese Decision on Rejection dated Nov. 30, 2018 issued in Chinese Patent Application No. 201510917250.6 (with English translation).

Japanese Office Action dated Nov. 13, 2018 issued in Japanese Patent Application No. 2015-240479 (with English translation).

Office Action issued in corresponding Japanese Application No. 2015-240479, dated Jun. 11, 2019.

* cited by examiner

A

I-I'

CHIP ELECTRONIC COMPONENT

CROSS-REFERENCE TO RELATED APPLICATION

This application claims benefit of priority to Korean Patent Application No. 10-2014-0177855 filed on Dec. 10, 2014, with the Korean Intellectual Property Office, the disclosure of which is incorporated herein by reference.

TECHNICAL FIELD

The present disclosure relates to a chip electronic component.

BACKGROUND

An inductor, a type of chip electronic component, is a typical passive element forming an electronic circuit, together with a resistor and a capacitor, to cancel noise therefrom.

The inductor is manufactured by forming an internal coil unit within a magnetic body including a magnetic material and subsequently forming external electrodes on external surfaces of the magnetic body.

SUMMARY

An aspect of the present disclosure may provide a chip electronic component having high inductance (L) and excellent quality (Q) factor and DC-bias properties (change characteristics of inductance according to current application).

According to an aspect of the present disclosure, a chip electronic component in which a magnetic metal plate is disposed on at least one of upper and lower surfaces of a magnetic body in which an internal coil unit is embedded is provided.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
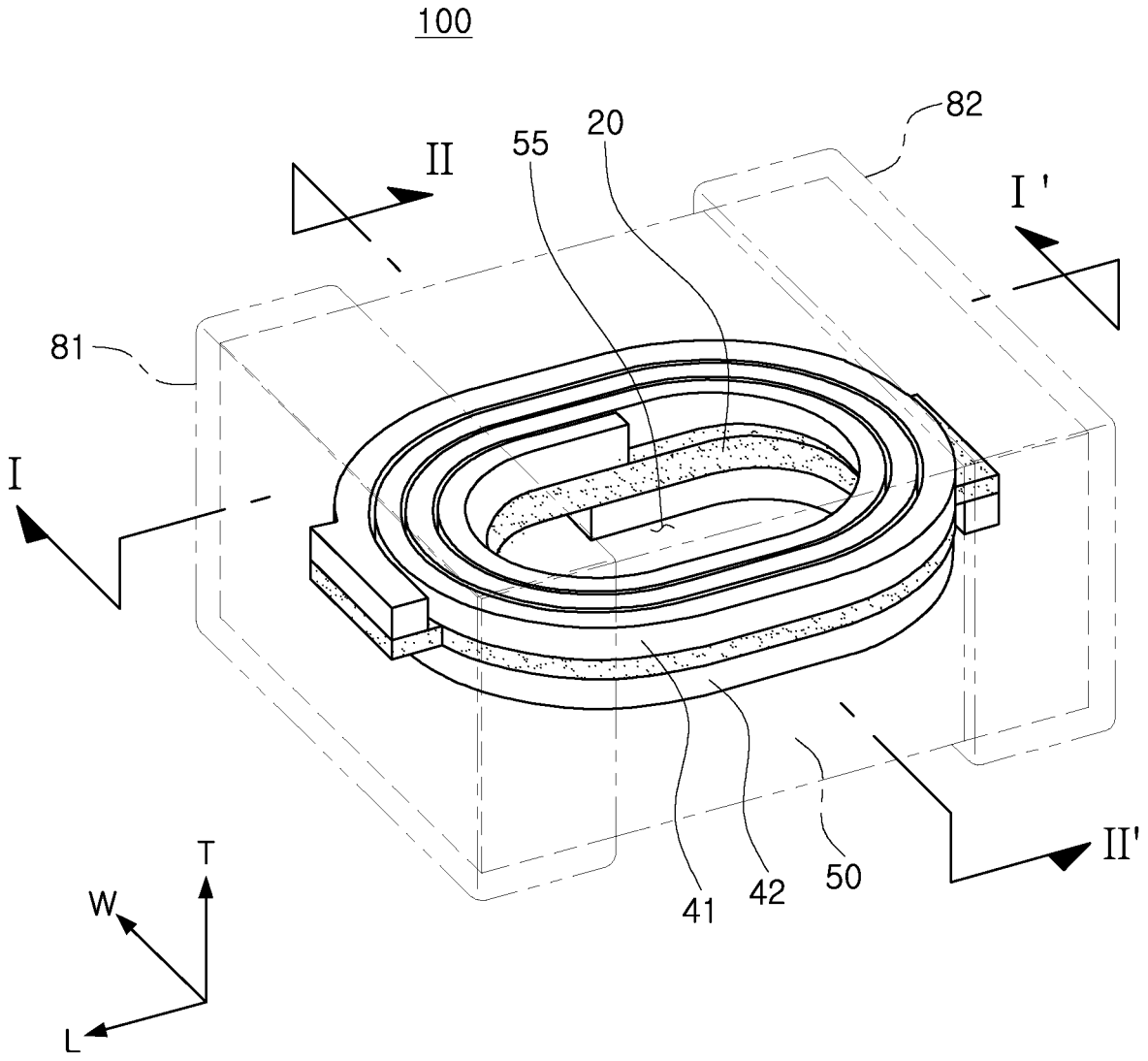
FIG. 1 is a perspective view schematically illustrating a chip electronic component including an internal coil unit according to an exemplary embodiment in the present disclosure.

Hereinafter, exemplary embodiments of the present inventive concept will be described in detail with reference to the accompanying drawings. The inventive concept may, however, be exemplified in many different forms and should not be construed as being limited to the specific embodiments set forth herein. Rather, these embodiments are provided so that this disclosure will be thorough and complete, and will fully convey the scope of the inventive concept to those skilled in the art. In the drawings, the shapes and dimensions of elements may be exaggerated for clarity, and the same reference numerals will be used throughout to designate the same or like elements To clarify the present invention, portions irrespective of description are limited and like numbers refer to like elements throughout the specification, and in the drawings, the thickness of layers, films, panels, regions, etc., are exaggerated for clarity. Also, in the drawings, like reference numerals refer to like elements although they are illustrated in different drawings.

Throughout the specification, unless explicitly described to the contrary, the word "comprise" and variations such as "comprises" or "comprising," will be understood to imply the inclusion of stated elements but not the exclusion of any other elements.

Hereinafter, a thin film type inductor will be described as an example of a chip electronic component according to an exemplary embodiment in the present disclosure, but the chip electronic component is not limited thereto.

FIG. 1 is a perspective view schematically illustrating a chip electronic component including an internal coil unit according to an exemplary embodiment in the present disclosure.

Referring to FIG. 1, a thin film type inductor used in a power line of a power supply circuit is disclosed as an example of a chip electronic component.

The chip electronic component 100 according to an exemplary embodiment in the present disclosure includes a magnetic body 50, first and second internal coil units 41 and 42 embedded in the magnetic body 50, and first and second external electrodes 81 and 82 disposed on external surfaces of the magnetic body 50 and connected to the internal coil units 41 and 42.

In the chip electronic component 100 according to an exemplary embodiment in the present disclosure, it is defined that a length direction is the "L" direction, a width direction is the "W" direction, and a thickness direction is the "T" direction in FIG. 1.

In the chip electronic component 100 according to an exemplary embodiment in the present disclosure, the first internal coil unit 41 having a planar coil shape is formed on one surface of an insulating substrate 20, and the second internal coil unit 42 having a planar coil shape is formed on the other surface of the insulating substrate 20 opposing the one surface thereof.

The first and second internal coil units 41 and 42 may be formed by performing electroplating on the insulating substrate 20, but the manner in which the first and second internal coil units 41 and 42 are formed is not limited thereto.

The first and second internal coil units 41 and 42 may have a spiral shape, and the first and second internal coil units 41 and 42 respectively formed on the one surface and the other surface of the insulating substrate 20 are electrically connected by a via (not shown) penetrating through the insulating substrate 20.

The first and second internal coil units 41 and 42 and the via may be formed to include a metal having excellent electrical conductivity, for example, silver (Ag), palladium (Pd), aluminum (Al), nickel (Ni), titanium (Ti), gold (Au), copper (Cu), platinum (Pt), or alloys thereof.

The first and second internal coil units 41 and 42 may be covered with an insulating film (not shown) and thus may not be in direct contact with a magnetic material forming the magnetic body 50.

The insulating substrate 20 is formed as a polypropyleneglycol (PPG) substrate, a ferrite substrate, or a metal-based soft magnetic substrate.

A through hole is formed in a central portion of the insulating substrate 20. The through hole is filled with a magnetic material to form a core part 55. Since the core part 55 is formed by filling the through hole with a magnetic material, inductance (L) may be enhanced.

However, the insulating substrate 20 may not necessarily be included, and the first and second internal coil units 41 and 42 may be formed with a metal wire, without the insulating substrate 20.

One end of the first internal coil unit 41 formed on one surface of the insulating substrate 20 may be exposed to one end surface of the magnetic body 50 in the length (L) direction, and one end of the second internal coil unit 42 formed on the other surface of the insulating substrate 20 is exposed to the other end surface of the magnetic body 50 in the length (L) direction.

However, the configuration is not limited thereto and one ends of the first and second internal coil units 41 and 42 may be exposed to at least one surface of the magnetic body 50.

The first and second external electrodes 81 and 82 are formed on external surfaces of the magnetic body 50 and connected to the first and second internal coil units 41 and 42 exposed to the end surfaces of the magnetic body 50, respectively.

The first and second external electrodes 81 and 82 may include a metal having excellent electrical conductivity, for example, copper (Cu), silver (Ag), nickel (Ni), tin (Sn), or alloys thereof.

Figure 2:
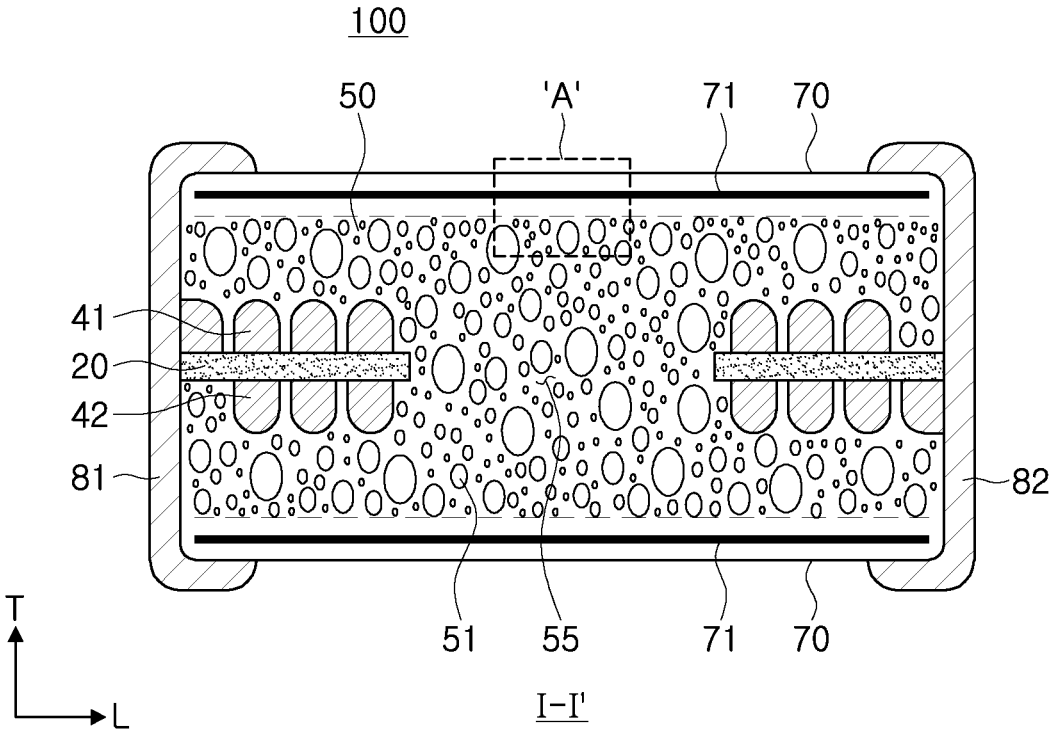
FIG. 2 is a cross-sectional view of the chip electronic component, taken along line I-I' of FIG. 1.
Figure 3:
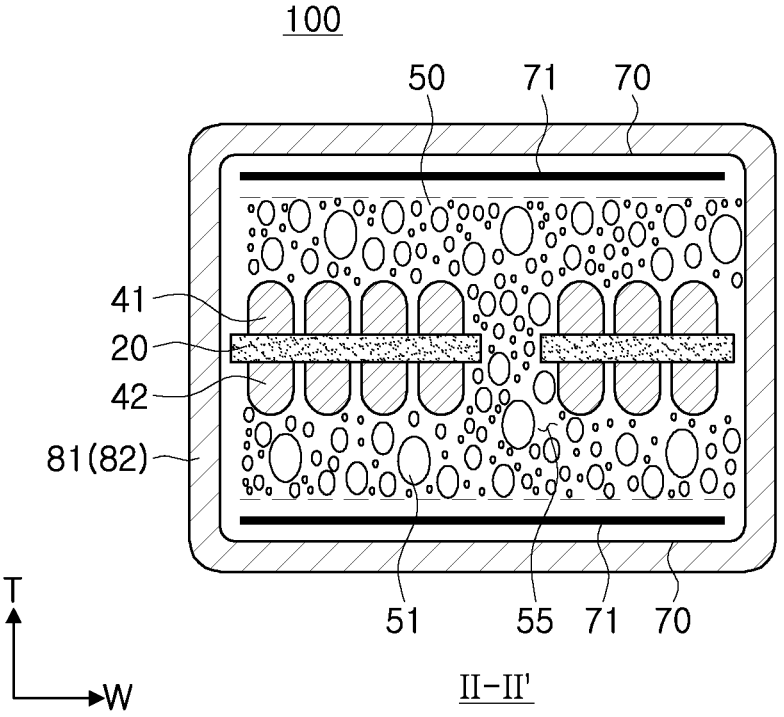
FIG. 3 is a cross-sectional view of the chip electronic component, taken along line II-II' of FIG. 1.

FIG. 2 is a cross-sectional view of the chip electronic component, taken along line I-I' of FIG. 1, and FIG. 3 is a cross-sectional view of the chip electronic component, taken along line II-II' of FIG. 1.

Referring to FIGS. 2 and 3, the magnetic body 50 of the chip electronic component 100 according to an exemplary embodiment in the present disclosure includes magnetic metal powder particles 51. However, the powder particles are not limited thereto and any powder may be used as long as it exhibits magnetic characteristics.

In the chip electronic component 100 according to an exemplary embodiment in the present disclosure, a cover unit 70 including a magnetic metal plate 71 is disposed on at least one of upper and lower surfaces of the magnetic body 50 including the magnetic metal powder particles 51.

The boundary between the magnetic body 50 and the cover unit 70 may be discernable using a scanning electron microscope, but the magnetic body 50 and the cover unit 70 may not necessarily divided by the boundary able to be observed using the SEM, and a region including the magnetic metal plate 71 may be identified as the cover unit 70.

The cover unit 70 including the magnetic metal plate 71 has higher magnetic permeability than that of the magnetic body 50 including the magnetic metal powder particles 51. Also, the cover unit 70 including the magnetic metal plate 71 may serve to prevent the leakage of magnetic flux outwardly.

Thus, the chip electronic component 100 according to an exemplary embodiment in the present disclosure may have high inductance and excellent DC-bias characteristics.

The magnetic metal powder particles 51 may be spherical powder particles or flake-shaped powder particles.

The magnetic metal powder particles 51 may be crystalline or amorphous metal including one or more selected from the group consisting of iron (Fe), silicon (Si), boron (B), chromium (Cr), aluminum (Al), copper (Cu), niobium (Nb), and nickel (Ni).

For example, the magnetic metal powder particles 51 may be formed of Fe—Si—B—Cr-based spherical amorphous metal particles.

The magnetic metal powder particles 51 may be included and dispersed in a thermosetting resin such as epoxy or polyimide.

The magnetic body 50 may include a mixture of magnetic metal powder particles having a larger average particle diameter and magnetic metal powder particles having a smaller average particle diameter.

The magnetic metal powder particles having a larger average particle diameter may realize high magnetic permeability, and the magnetic metal powder particles having a smaller average particle diameter may be mixed with the magnetic metal powder particles having a larger average particle diameter to enhance a packing factor. As the packing factor is increased, magnetic permeability may be further enhanced.

Here, the use of the magnetic metal powder particles having a larger average particle diameter may obtain a high degree of magnetic permeability but lead to increased core loss. However, since the magnetic metal powder particles having a smaller average particle diameter is a low-loss material, the magnetic metal powder particles having a smaller average particle diameter may be mixed with the magnetic metal powder particles having a larger average particle diameter to complement core loss increased as the magnetic metal powder particles having a larger average particle diameter is used, thus enhancing a Q factor together.

As a result, since the mixture of the magnetic metal powder particles having a larger average particle diameter and the magnetic metal powder particles having a smaller average particle diameter is provided, inductance and the Q factor may be enhanced.

However, only the mixing of the magnetic metal powder particles having a larger average particle diameter and the magnetic metal powder particles having a smaller average particle diameter has a limitation in the enhancement of magnetic permeability.

Thus, in an exemplary embodiment in the present disclosure, the magnetic metal plate 71 is provided to further enhance magnetic permeability.

The magnetic metal plate 71 exhibits magnetic permeability about 2 to 10 times greater than that of the magnetic metal powder particles 51. The magnetic metal plate 71 may be disposed in the form of a plate on upper and lower surfaces of the magnetic body 50 to prevent the leakage of magnetic flux outwardly.

The magnetic metal plate 71 may be formed of a crystalline or amorphous metal including one or more selected from the group consisting of iron (Fe), silicon (Si), boron (B), chromium (Cr), aluminum (Al), copper (Cu), niobium (Nb), and nickel (Ni).

An end portion of the magnetic metal plate 71 is insulated, without being electrically connected to the first and second external electrodes 81 and 82 disposed on the external surfaces of the magnetic body 50.

In FIGS. 2 and 3, it is illustrated that the magnetic metal plates 71 are disposed in the uppermost portion and in the lowermost portion of the magnetic body 50 to form the cover units 70, but the structure is not limited thereto. That is, any structure may be used as long as at least one magnetic metal plate is disposed within a range in which a person skilled in the art may utilize the configuration to obtain the effect of the present disclosure.

For example, the cover unit 70 including the magnetic metal plate 71 may also be formed on a side surface of the magnetic body 50, or may be formed in an internal region of the magnetic body 50, rather than in the uppermost portion or the lowermost portion of the magnetic body 50.

Figure 4:
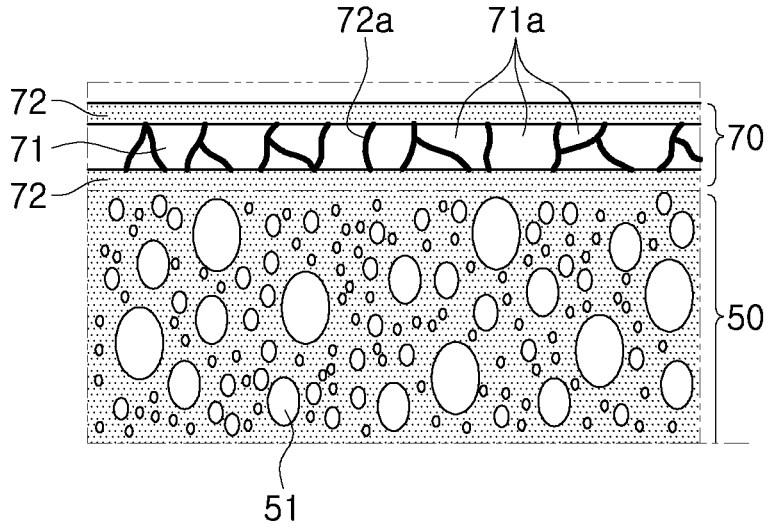
FIG. 4 is an enlarged view of portion 'A' of FIG. 2.

FIG. 4 is an enlarged view of portion 'A' of FIG. 2.

Referring to FIG. 4, the magnetic metal plate 71 according to an exemplary embodiment in the present disclosure is cracked to form a plurality of metal fragments 71*a*.

If the magnetic metal plate 71 is used in the form of a plate as is, without being cracked, the magnetic metal plate 71 may exhibit high magnetic permeability, about 2 to 10 times greater than that of the magnetic metal powder particles 51, but core loss is drastically increased due to eddy currents, which may degrade a Q factor.

Thus, in an exemplary embodiment in the present disclosure, the magnetic metal plate 71 is cracked to form the plurality of metal fragments 71*a* to obtain high magnetic permeability and improve core loss.

Thus, the chip electronic component 100 according to an exemplary embodiment in the present disclosure may have enhanced magnetic permeability to satisfy an excellent Q factor, while securing high inductance.

The magnetic metal plate 71 is cracked such that adjacent metal fragments 71*a* have shapes corresponding to each other.

After the magnetic metal plate 71 is cracked to form the metal fragments 71*a*, the metal fragments 71*a* are positioned in the cracked state as is, forming a layer, rather than being irregularly dispersed, and thus, the adjacent metal fragments 71*a* have mutually corresponding shapes.

Here, when the adjacent metal fragments 71*a* have the mutually corresponding shapes, a degree to which a state in which the metal fragments 71*a* are positioned in the cracked state, forming a layer as is, rather than that the mutually adjacent metal fragments 71*a* are not perfectly matched, is determined.

The cover unit 70 further includes a thermosetting resin layer 72 disposed on at least one of upper and lower surfaces of the magnetic metal plate 71.

The thermosetting resin layer 71 may include a thermosetting resin such as epoxy or polyimide.

Spaces between the adjacent metal fragments 71*a* of the cracked magnetic metal plate 71 are filled with the thermosetting resin 72*a*.

The thermosetting resin 72*a* may be a thermosetting resin of the thermosetting resin layer 72 permeated into the spaces between the adjacent metal fragments 71*a* in the process of compressing and cracking the magnetic metal plates 71. In this case, the thermosetting resin 72*a* permeated into the spaces between the adjacent metal fragments 71*a* and the thermosetting resin layer 72 may still be integrally formed. The thermosetting resin 72*a* permeated into the spaces between the adjacent metal fragments 71*a* may directly connect the thermosetting resin layers 72 formed on the opposite surfaces of the cracked magnetic metal plate 71 to each other.

The thermosetting resin 72*a* filling the spaces between the adjacent metal fragments 71*a* insulates the adjacent metal fragments 71*a*.

Thus, core loss of the magnetic metal plate 71 may be reduced and a Q factor thereof may be enhanced.

Figure 5:
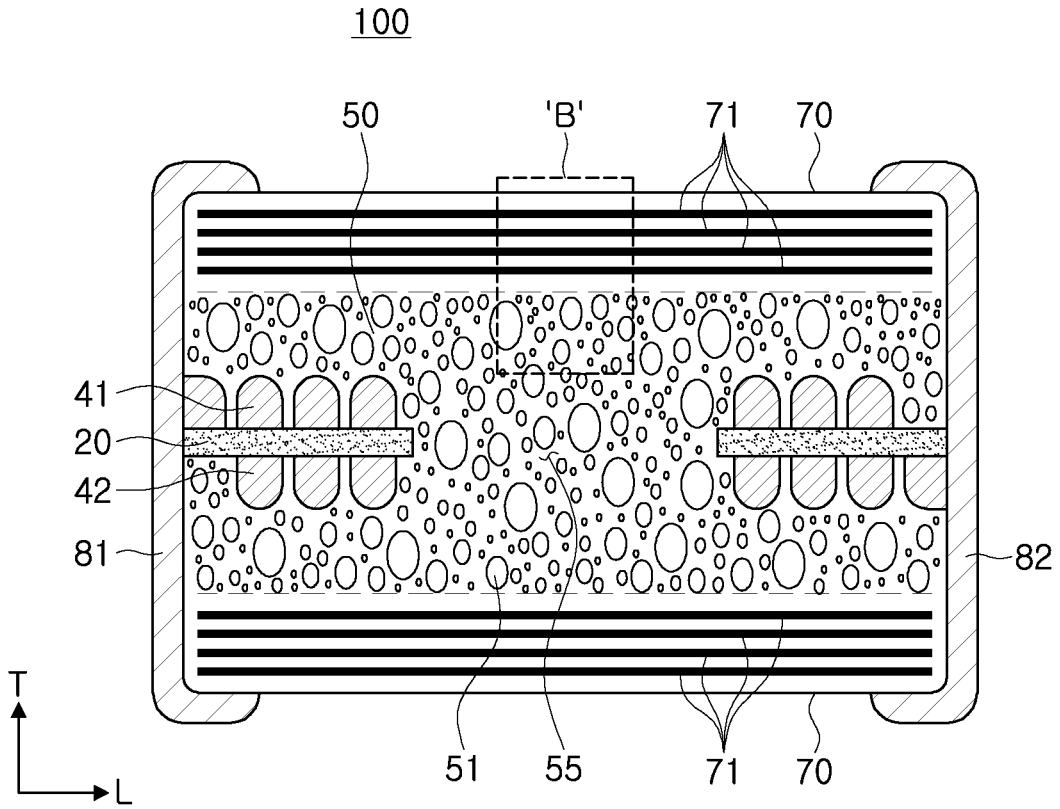
FIG. 5 is a cross-sectional view of a chip electronic component in the length and thickness directions according to another exemplary embodiment in the present disclosure.

FIG. 5 is a cross-sectional view of a chip electronic component in the length and thickness directions according to another exemplary embodiment in the present disclosure.

Referring to FIG. 5, a cover unit 70 of the chip electronic component 100 according to another exemplary embodiment in the present disclosure includes a plurality of magnetic metal plates 71.

The cover unit 70 includes the magnetic metal plates 71 stacked as a plurality of layers.

Figure 6:
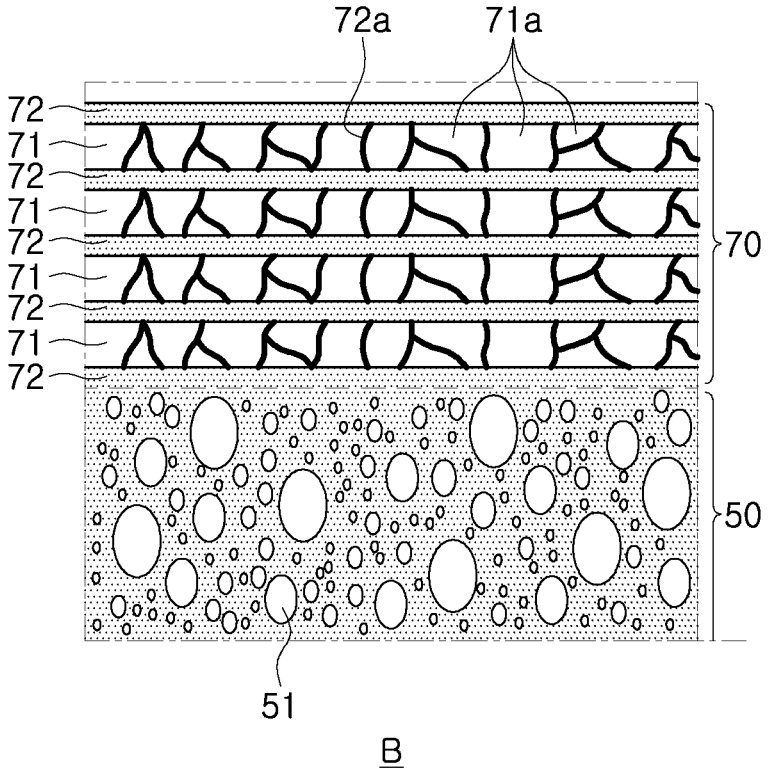
FIG. 6 is an enlarged view of portion 'B' of FIG. 5.

FIG. 6 is an enlarged view of portion 'B' of FIG. 5.

Referring to FIG. 6, the cover unit 70 is formed by alternately stacking the plurality of magnetic metal plates 71 and the thermosetting resin layers 72.

The thermosetting resin layers 72 are formed between the plurality of magnetic metal plates 71 to insulate the adjacently stacked magnetic metal plates 71.

The magnetic metal plates 71 are cracked such that adjacent metal fragments 71*a* of the same magnetic metal plate 71 have shapes corresponding to each other.

That is, the metal fragments 71*a* formed as the magnetic metal plate 71 of one layer is cracked are positioned in the cracked state as is, forming a layer.

Spaces between the adjacent metal fragments 71*a* of the cracked magnetic metal plate 71 are filled with the thermosetting resin 72*a*, and the thermosetting resin 72*a* filling the spaces between the adjacent metal fragments 71*a* insulate the adjacent metal fragments 71*a*. In this case, the thermosetting resin 72*a* filled into the spaces between the adjacent metal fragments 71*a* and the thermosetting resin layer 72 may be integrally formed. The thermosetting resin 72*a* filled into the spaces between the adjacent metal fragments 71*a* may directly connect the thermosetting resin layers 72 formed on the opposite surfaces of the same cracked magnetic metal plate 71 to each other.

The cover unit 70 includes the plurality of magnetic metal plates 71 to have further enhanced magnetic permeability and secure higher inductance.

Preferably, the cover unit 70 may include magnetic metal plates 71 of four or more layers.

Figure 7:
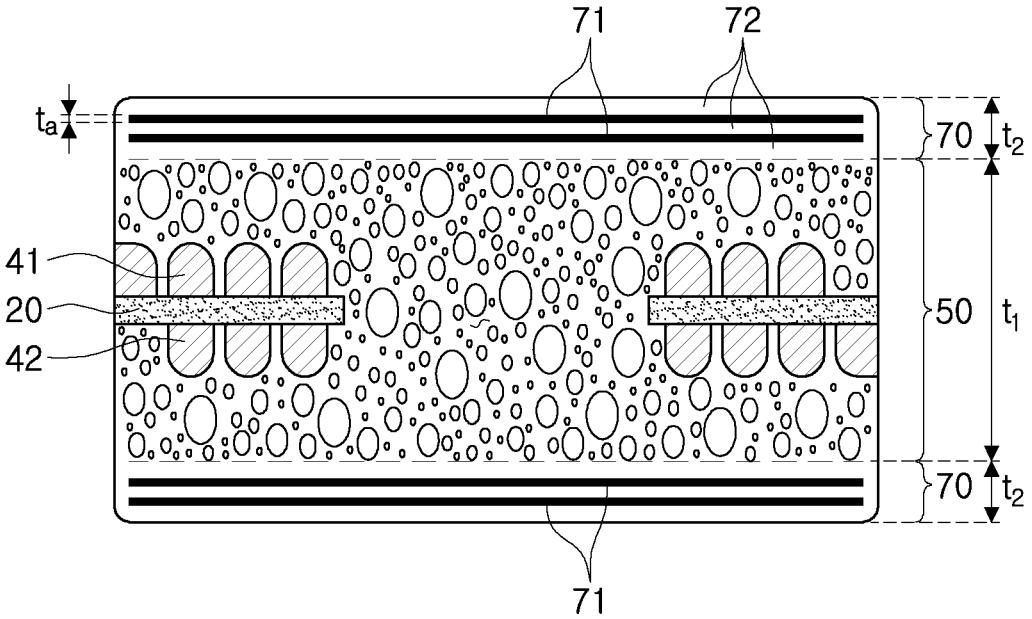
FIG. 7 is a cross-sectional view illustrating a magnetic body and a cover unit of a chip electronic component according to an exemplary embodiment in the present disclosure.

FIG. 7 is a cross-sectional view illustrating a magnetic body and a cover unit of a chip electronic component according to an exemplary embodiment in the present disclosure.

Referring to FIG. 7, when a thickness of the magnetic body 50 including the magnetic metal powder particles 51 is $t_1$ and a thickness of the cover unit 70 including the magnetic metal plates 71 is $t_2$, the thickness $t_2$ of the cover unit 70 may be equal to 5% to 50% of the thickness $t_1$ of the magnetic body 50.

If the thickness $t_2$ of the cover unit 70 is less than 5% of the thickness $t_1$ of the magnetic body 50, the effect of enhancing magnetic permeability and reducing magnetic flux may be degraded, and if the thickness $t_2$ of the cover unit 70 exceeds 50% of the thickness $t_1$ of the magnetic body 50, core loss may be increased and a Q factor may be degraded.

An average thickness $t_a$ of the magnetic metal plates 71 may range from 5 μm to 30 μm.

The core loss may be reduced and the Q factor may be enhanced as the average thickness $t_a$ of the magnetic metal plates 71 is reduced. When the average thickness $t_a$ of the magnetic metal plates 71 exceeds 30 μm, the core loss may be increased and the Q factor may be degraded.

Surface roughness of the cover unit 70 including the magnetic metal plates 71 may be 10 μm or less.

In another exemplary embodiment in which the cover unit 70 including the magnetic metal plates 71 is not formed in the uppermost portion and the lowermost portion of the magnetic body 50, surface roughness may be great to exceed 10 μm. In particular, surface roughness may be increased as magnetic metal powder particles having a large average particle diameter are used to enhance magnetic permeability.

The individual magnetic metal powder particles having a large average particle diameter may protrude from the surface of the magnetic body 50 and an insulating coating layer of the protruded portion may be delaminated in the process of polishing the magnetic body cut to individual chip size, leading to a defect of plating solution spreading when a plated layer is formed on the external electrodes.

However, in an exemplary embodiment in the present disclosure, since the cover unit 70 including the magnetic metal plates 71 is formed, surface roughness may be improved to be 10 μm or less, and spreading of the plating solution may be prevented.

The magnetic metal plates 71 are cracked to form a plurality of metal fragments 71*a*, and here, the metal fragments 71*a* are positioned in the cracked state as is, forming a layer, rather than being irregularly dispersed after the magnetic metal plates 71 are cracked, and thus, surface roughness may be 10 μm or less, unlike the magnetic metal powder particles.

Figure 8A:
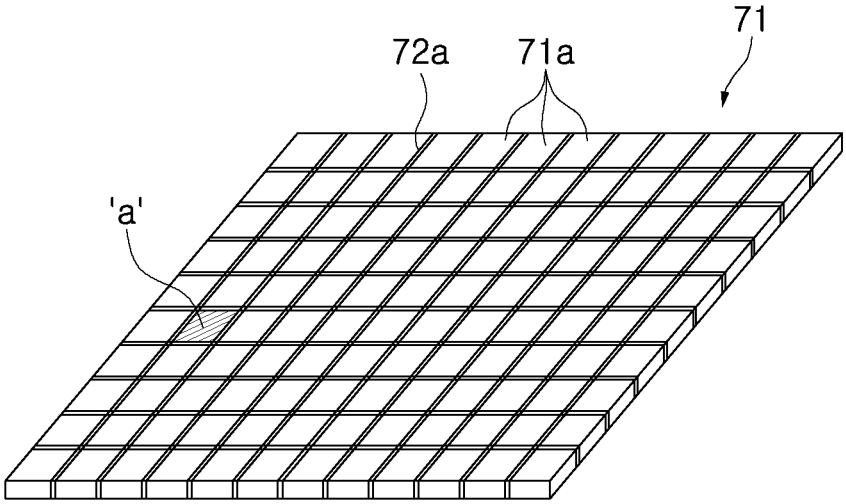
FIGS. 8A and 8B are perspective views schematically illustrating a cracked form of a magnetic metal plate according to an exemplary embodiment in the present disclosure.
Figure 8B:
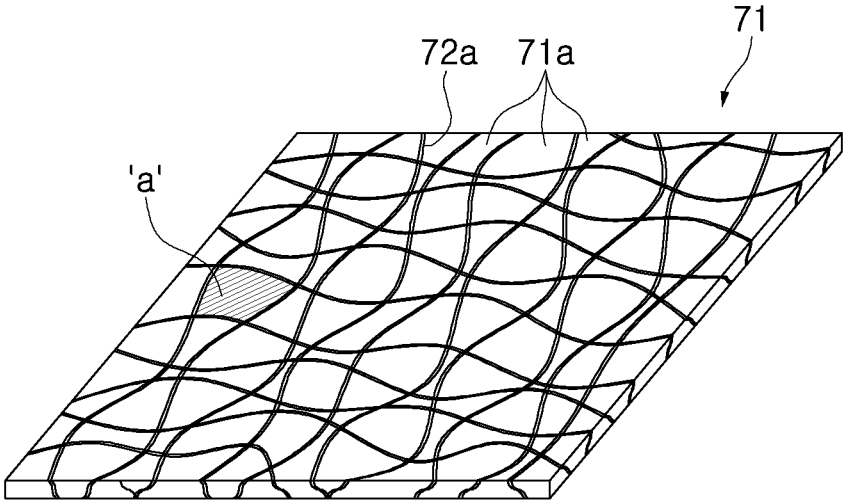

FIGS. 8A and 8B are perspective views schematically illustrating a cracked form of a magnetic metal plate according to an exemplary embodiment in the present disclosure.

Referring to FIG. 8A, the magnetic metal plate 71 according to an exemplary embodiment in the present disclosure is cracked to have metal fragments 71*a* in a lattice form.

In FIG. 8A, the magnetic metal plate 71 cracked to have metal fragments 71*a* in the lattice form is illustrated, but the magnetic plate 71 is not limited thereto and any magnetic metal plate may be used as long as it is cracked to form regular shapes within a range in which a person skilled in the art may utilize the magnetic metal plate 71.

The number, volume, and shape of the regularly cracked metal fragments 71*a* are not particularly limited and any structure may be used as long as it can obtain the effect of the present disclosure.

More preferably, an area (a) of a cross-section of the metal fragments 71*a* in the length-width direction, that is, of an upper surface or a lower surface of the regularly cracked metal fragments 71*a* may range from 0.0001 $\mu m^2$ to 40000 $\mu m^2$.

If the area (a) of the upper surface or the lower surface of the metal fragments 71*a* is less than 0.0001 $\mu m^2$, magnetic permeability may be drastically degraded, and if the area (a) of the upper surface or the lower surface of the metal fragments 71*a* exceeds 40000 $\mu m^2$, loss due to eddy currents may be increased to degrade a Q factor.

Referring to FIG. 8B, a magnetic metal plate 71 according to another exemplary embodiment in the present disclosure may be cracked to have amorphous metal fragments 71*a*.

The magnetic metal plate 71 may not be necessarily cracked to form regular shapes, and as illustrated in FIG. 8B, the magnetic metal plate 71 may be cracked to have an amorphous shape within a range in which the effect of the present disclosure may be obtained.

An average of the area (a) of the cross-section of the metal fragments 71*a* in the length-width direction, that is, of an upper surface or a lower surface of the irregularly cracked metal fragments 71*a* may range from 0.0001 $\mu m^2$ to 40000 $\mu m^2$.

As discussed above, spaces between the adjacent metal fragments 71*a* of the cracked magnetic metal plate 71 are filled with the thermosetting resin 72*a*, and the thermosetting resin 72*a* filling the spaces between the adjacent metal fragments 71*a* insulates the adjacent metal fragments 71*a*.

Hereinafter, a method of manufacturing a chip electronic component 10 according to an exemplary embodiment in the present disclosure will be described.

Figure 9A:
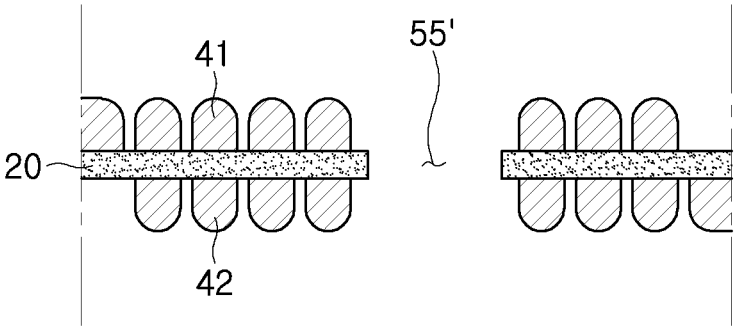
FIGS. 9A and 9B are views illustrating a process of forming a magnetic body of a chip electronic component according to an exemplary embodiment in the present disclosure.
Figure 9B:
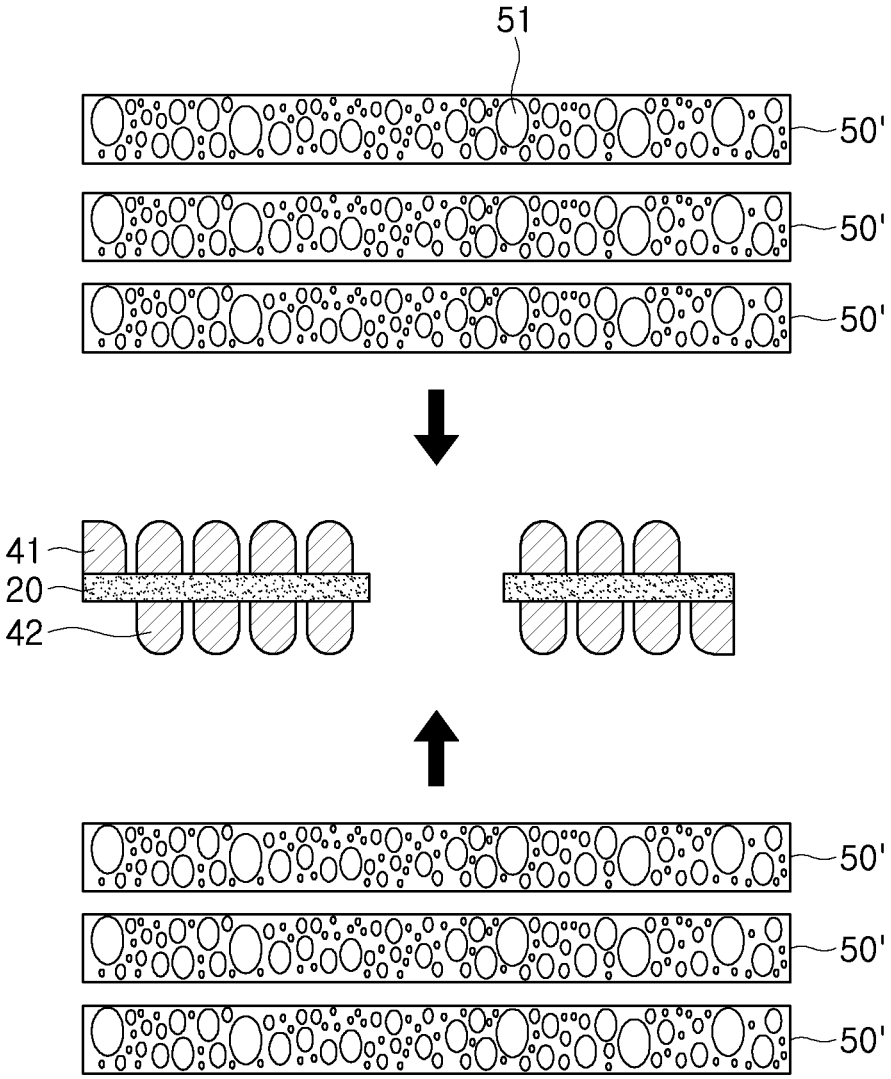

FIGS. 9A and 9B are views illustrating a process of forming a magnetic body of a chip electronic component according to an exemplary embodiment in the present disclosure.

Referring to FIG. 9A, first and second internal coil units 41 and 42 are formed on one surface and the other surface of an insulating substrate 20, respectively.

A via hole (not shown) is formed in the insulating substrate 20, a plating resist having an opening is formed on the insulating substrate 20, and the via hole and the opening are subsequently filled with a conductive metal through plating to form the first and second internal coil units 41 and 42 and a via (not shown) connecting the first and second internal coil units 41 and 42.

However, the method of forming the first and second internal coil units 41 and 42 is not limited to the plating method and the internal coil units may be formed of a metal wire.

An insulating layer (not shown) may be formed on the first and second internal coil units 41 and 42 to cover the first and second internal coil units 41 and 42.

The insulating layer (not shown) may be formed through a method known in the art such as a screen printing method, a process of the exposure and development of photoresist (PR), or a spray coating method.

A central portion of a region of the insulating substrate 20 in which the first and second internal coil units 41 and 42 are not formed is removed to form a core part hole 55'.

The removing of the insulating substrate 20 may be performed through mechanical drilling, laser drilling, sand blasting, or a punching process.

Referring to FIG. 9B, magnetic sheets 50' are stacked above and below the first and second internal coil units 41 and 42.

The magnetic sheets 50' may be manufactured by preparing a slurry by mixing magnetic metal powder particles 51, a thermosetting resin, and an organic material such as a binder or a solvent, and applying the slurry to a carrier film to have a thickness of tens of μm through a doctor blade method, and subsequently drying the slurry to form the sheets.

As the magnetic metal powder particles 51, spherical powder particles or flake-shaped powder particles may be used.

The magnetic sheets 50' may be manufactured by mixing magnetic metal powder particles having a larger average particle diameter and magnetic metal powder particles having a smaller average particle diameter.

The magnetic sheets 50' may be manufactured by dispersing the magnetic metal powder particles 51 in a thermosetting resin such as epoxy or polyimide.

The magnetic sheets 50' are stacked, compressed, and cured to form a magnetic main body 50 in which the internal coil units 41 and 42 are embedded.

Here, the core part hole 55' is filled with a magnetic material to form a core part 55.

However, the process of forming the magnetic body 50 by stacking the magnetic sheets 50' is illustrated in FIG. 9B, but the present disclosure is not limited thereto and any method may be applied as long as it can form a magnetic metal powder-resin composite in which internal coil units are embedded.

FIGS. 10A through 10E are views illustrating a process of forming a cover unit including a magnetic metal plate of a chip electronic component according to an exemplary embodiment in the present disclosure.

Figure 10A:
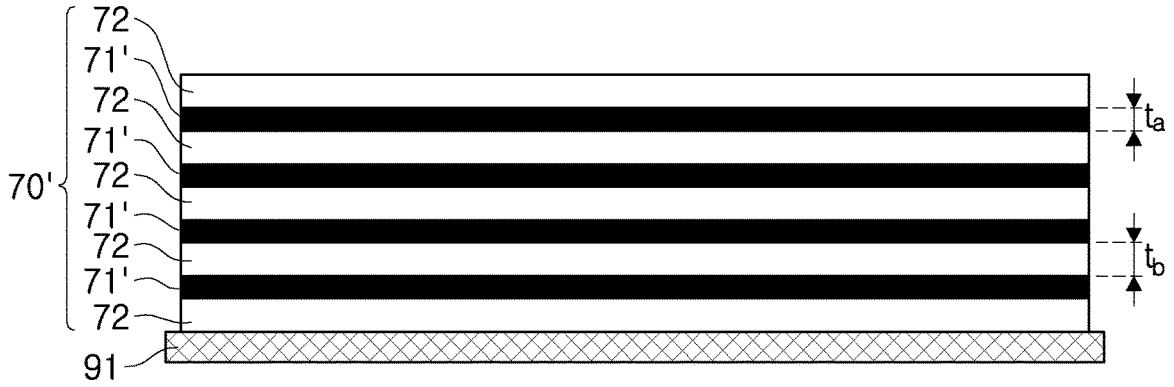
FIGS. 10A through 10E are views illustrating a process of forming a cover unit including a magnetic metal plate of a chip electronic component according to an exemplary embodiment in the present disclosure.

Referring to FIG. 10A, metal plates 71' and thermosetting resin layers 72 are alternately stacked on a support film 91 to form a stacked body 70'.

The support film 91 is not particularly limited as long as it can support the stacked body 70', and, for example, a fluoride resin-based film such as a polyethylene terephthalate (PET) film, a polyimide film, a polyester film, a polyphenylenesulfide (PPS) film, a polypropylene (PP) film, or a polyterephthalate (PTFE) film may be used as the support film 91.

A thickness of the support film 91 may range from 0.1 μm to 20 μm.

The magnetic metal plates 71' may be formed of a crystalline or amorphous metal including one or more selected from the group consisting of iron (Fe), silicon (Si), boron (B), chromium (Cr), aluminum (Al), copper (Cu), niobium (Nb), and nickel (Ni).

A thickness $t_a$ of the magnetic metal plates 71' may range from 5 μm to 30 μm.

Core loss may be reduced and a Q factor may be enhanced as the average thickness $t_a$ of the magnetic metal plates 71 is reduced. When an average thickness $t_a$ of the magnetic metal plates 71 exceeds 30 μm, the core loss may be increased and the Q factor may be degraded.

The thermosetting resin layer 72 may include a thermosetting resin such as epoxy or polyimide.

A thickness $t_b$ of the thermosetting resin layer 72 may be 1.0 to 2.5 times the thickness $t_a$ of the magnetic metal plate 71'.

If the thickness $t_b$ of the thermosetting resin layer 72 is less than 1.0 times the thickness $t_a$ of the magnetic metal plate 71', an insulating effect between the adjacent magnetic metal plate 71' and the metal fragment 71*a* may be degraded, and if the thickness $t_b$ of the thermosetting resin layer 72 exceeds the thickness $t_a$ of the magnetic metal plate 71' by 2.5 or more times, the effect of enhancing magnetic permeability may be degraded.

More preferably, the thickness $t_b$ of the thermosetting resin layer 72 may be 1.5 to 2.0 times the thickness $t_a$ of the magnetic metal plate 71', and may be 7.5 μm to 10 μm, for example.

In FIG. 10A, the stacked body 70' formed by stacking four magnetic metal plates 71' is illustrated, but the present disclosure is not limited thereto and the stacked body 70 may also be formed by stacking at least one layer of magnetic metal plate 71' and thermosetting resin layer 72 on at least one of the upper and lower surfaces of the magnetic metal plate 71'.

More preferably, four or more layers of magnetic metal plates 71' may be stacked.

Figure 10B:
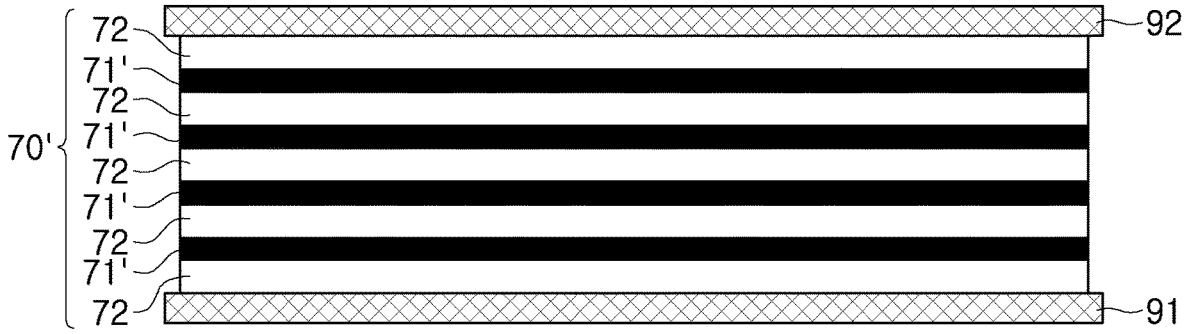

Referring to FIG. 10B, a cover film 92 is formed on the stacked body 70'.

The cover film may serve to fix the magnetic metal plate such that the magnetic metal plate is cracked to form a layer as is in the process of cracking the magnetic metal plate 71' by compressing the stacked body 70'.

The cover film 92 is not particularly limited as long as it can fix the stacked body 70', and, for example, a fluoride resin-based film such as a polyethylene terephthalate (PET) film, a polyimide film, a polyester film, a polyphenylenesulfide (PPS) film, a polypropylene (PP) film, or a polyterephthalate (PTFE), or an epoxy resin film may be used as the cover film 92.

A thickness of the cover film 92 may range from 1 μm to 20 μm.

Figure 10C:
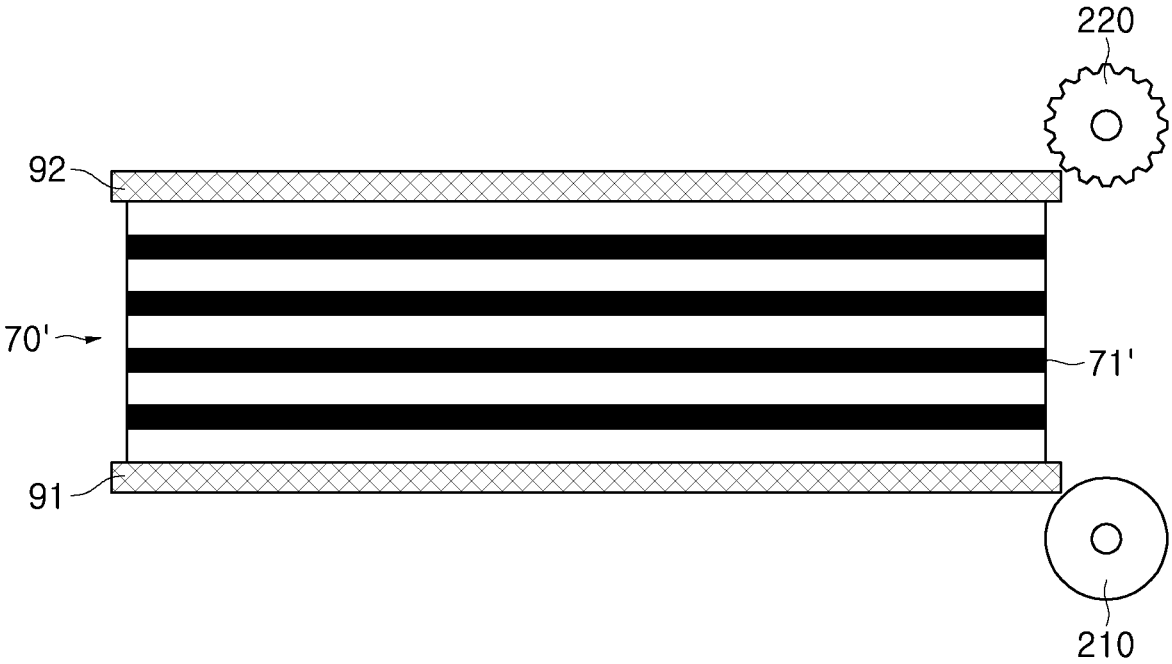

Referring to FIG. 10C, the stacked body 70' with the support film 91 and the cover film 92 formed thereon is compressed to crack the magnetic metal plates 71'.

If the magnetic metal plates 71' are used as is in the form of the plate, without being cracked, magnetic permeability about 2 to 10 times greater than that of the magnetic metal powder particles 51 may be obtained, but loss due to eddy currents is drastically increased to degrade a Q factor.

Thus, in an exemplary embodiment in the present disclosure, the magnetic metal plates 71' are cracked to form a plurality of metal fragments 71*a*, whereby high magnetic permeability may be obtained and core loss may be improved.

When the magnetic metal plates 71' are cracked to form the plurality of metal fragments 71*a*, magnetic permeability may be slightly reduced, but it still may remain high, and loss due to an eddy current is rather greatly reduced than the reduction in magnetic permeability.

As for the method of cracking the magnetic metal plates, for example, the stacked body 70' may be formed as illustrated in FIG. 10C and allowed to pass through rollers 210 and 220 disposed above and below the stacked body 70', thus allowing the magnetic metal plate 71' to be cracked into a plurality of metal fragments 71*a*.

The magnetic metal plates 71' may be a crystalline or amorphous metal, and when the magnetic metal plates 71' are heat-treated to form crystalloid, the magnetic metal plates 71' may be more effectively cracked.

The rollers 210 and 220 may be metal rollers or rubber rollers, and rollers having a plurality of irregular patterns formed on outer surfaces thereof may be used.

However, the method of cracking the magnetic metal plate 71' is not limited thereto and any method enabling the magnetic metal plates 71' to be cracked into a plurality of metal fragments 71*a* to obtain the effect of the present disclosure may be applied within a range in which a person skilled in the art may utilize it.

Figure 10D:
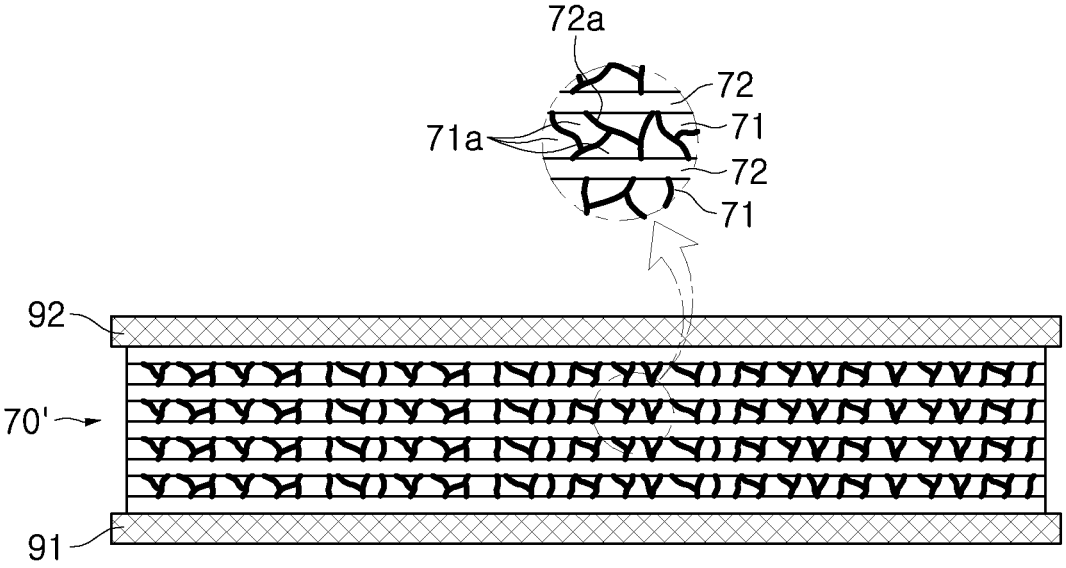

Referring to FIG. 10D, the magnetic metal plates 71 may be cracked to form the plurality of metal fragments 71*a*.

The magnetic metal plates 71 are cracked such that adjacent metal fragments 71*a* have shapes corresponding to each other.

After the magnetic metal plate 71 is cracked to form the metal fragments 71*a*, the metal fragments 71*a* are positioned in the cracked state as is to form a layer, rather than being irregularly dispersed, and thus, the adjacent metal fragments 71*a* have mutually corresponding shapes.

That is, when the adjacent metal fragments 71*a* have the mutually corresponding shapes, a degree to which a state in which the metal fragments 71*a* are positioned in the cracked state, forming a layer as is, rather than that the mutually adjacent metal fragments 71*a* are not perfectly matched, is determined.

Spaces between adjacent metal fragments 71*a* of the cracked magnetic metal plate 71 are filled with the thermosetting resin 72*a*.

The thermosetting resin 72*a* may be formed as a thermosetting resin of the thermosetting resin layer 72 permeates to the spaces between the adjacent metal fragments 71*a* in the process of compressing the stacked body 70' to crack the magnetic metal plates 71.

The thermosetting resin 72*a* filling the spaces between the adjacent metal fragments 71*a* insulates the adjacent metal fragments 71*a*.

Thus, core loss of the magnetic metal plate 71 may be reduced and a Q factor thereof may be enhanced.

Figure 10E:
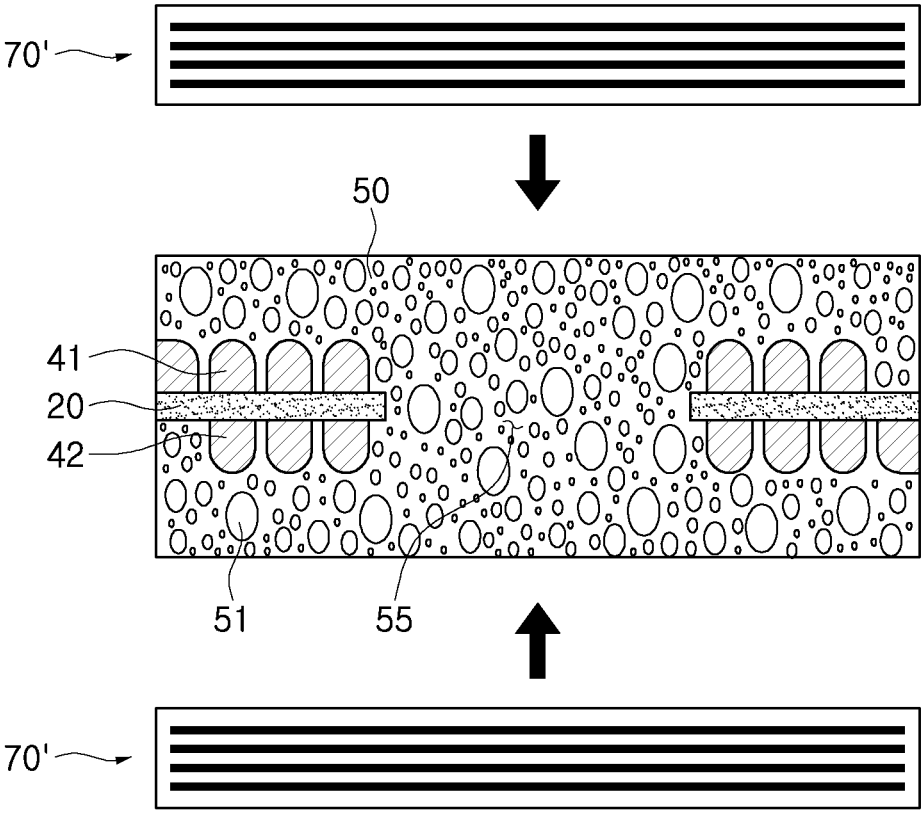

Referring to FIG. 10E, the stacked bodies 70' including the cracked magnetic metal plates 71 are formed on upper and lower surfaces of the magnetic body 50.

After the stacked bodies 70' including the cracked magnetic metal plates 71 are formed on upper and lower surfaces of the magnetic body 50, the stacked body 70', the magnetic body 50, and the stacked body 70' are compressed and cured through a laminate method or an isostatic pressing method so as to be integrated.

FIGS. 11A through 11D are views illustrating a process of forming a cover unit including a magnetic metal plate of a chip electronic component according to another exemplary embodiment in the present disclosure.

Figure 11A:
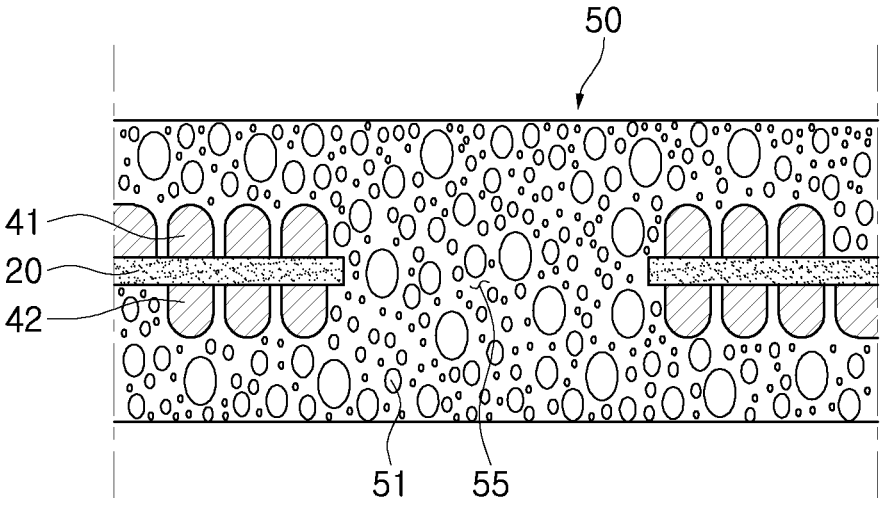
FIGS. 11A through 11D are views illustrating a process of forming a cover unit including a magnetic metal plate of a chip electronic component according to another exemplary embodiment in the present disclosure.

Referring to FIG. 11A, a magnetic body 50 in which internal coil units 41 and 42 are embedded therein is formed.

A method of forming the magnetic body 50 is not particularly limited and, for example, as illustrated in FIGS. 9A and 9B, the magnetic body 50 may be formed by stacking the magnetic sheets 50'.

Figure 11B:
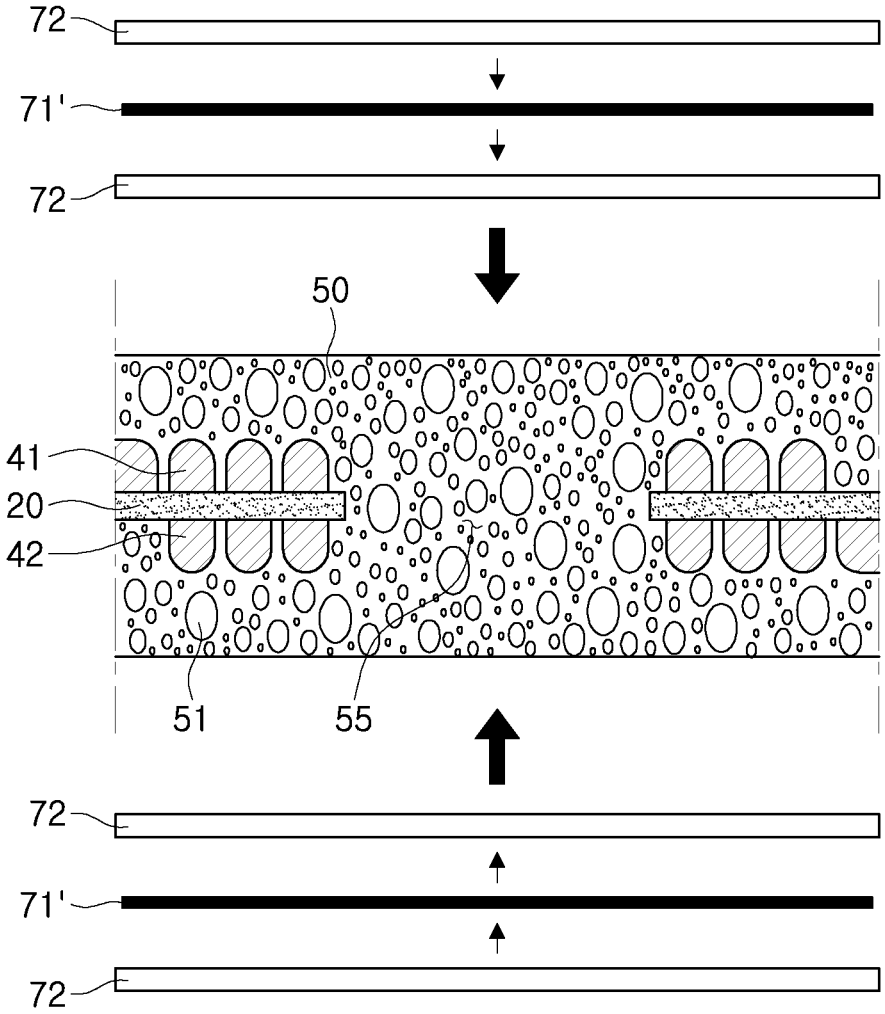

Referring to FIG. 11B, magnetic metal plates 71' are stacked on upper and lower surfaces of the magnetic body 50.

Here, a thermosetting resin layer 72 is further stacked on at least one of the upper and lower surfaces of the magnetic metal plates 71'.

In FIG. 11B, it is illustrated that a single layer of magnetic metal plate 71' is stacked on each of the upper and lower surfaces of the magnetic body 50, but the present disclosure is not limited thereto and the magnetic metal plate 71' may be stacked on at least one of the upper and lower surfaces of the magnetic body 50, and two or more magnetic metal plates 71' may be stacked thereon. When two or more layers of magnetic metal plates 71' are stacked, the magnetic metal plate 71' and the thermosetting resin layer 72 may be alternately stacked.

Figure 11C:
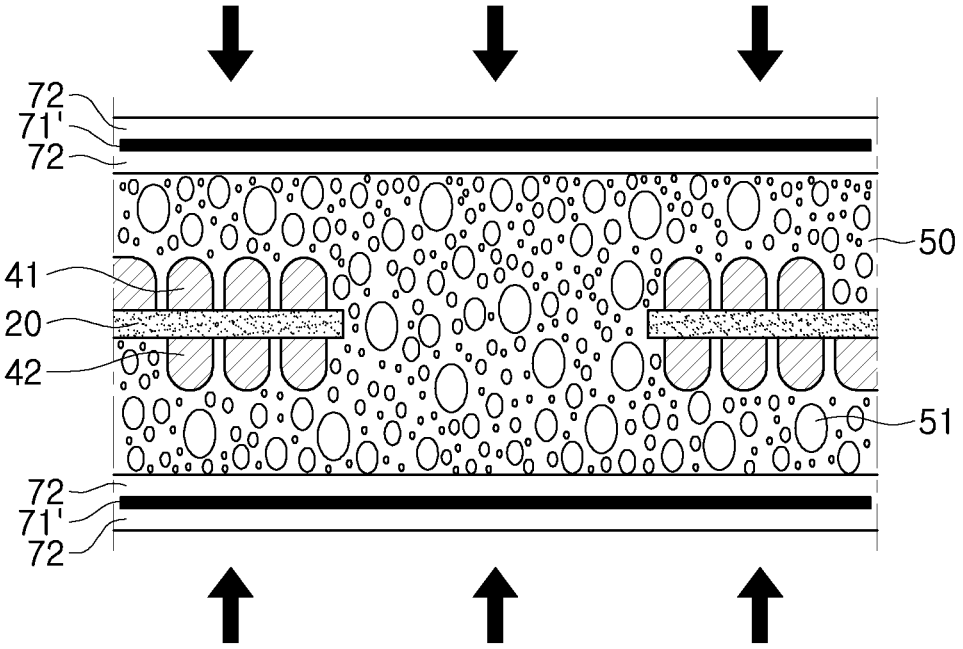

Referring to FIG. 11C, the magnetic metal plate 71' stacked on the magnetic body 50 is compressed to be cracked.

That is, as illustrated in FIGS. 10A through 10E, the magnetic metal plates 71' may be first cracked to form a plurality of metal fragments 71*a* and the metal plates 71' including the plurality of metal fragments 71 may be formed on the magnetic body 50, or alternately, as illustrated in FIGS. 11A through 11D, the magnetic metal plates 71', which are not cracked, may be formed on the magnetic body 50 and subsequently cracked into a plurality of metal fragments 71*a* through a compressing process according to another exemplary embodiment in the present disclosure.

Figure 11D:
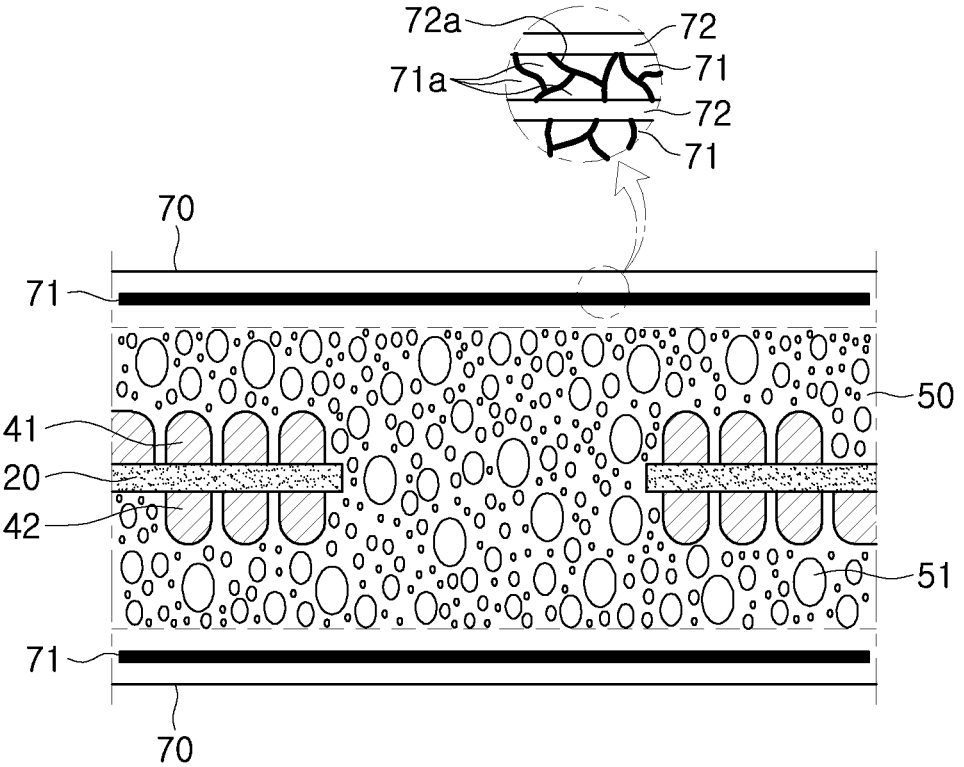

Referring to FIG. 11D, the cover units 70 including the magnetic metal plates 71 cracked to form the plurality of metal fragments 71*a* are formed on upper and lower surfaces of the magnetic body 50.

That is, after the magnetic metal plates 71, which are not cracked, may be formed on the magnetic body 50, the magnetic metal plates 71 may be compressed and cured through a laminate method or an isostatic pressing method so as to be cracked into a plurality of metal fragments 71*a*, and the magnetic body 50 and the cover units 70 including the magnetic metal plates 71 may be integrated.

Spaces between adjacent metal fragments 71*a* of the cracked magnetic metal plate 71 are filled with the thermosetting resin 72*a*.

The thermosetting resin 72*a* may be formed as a thermosetting resin of the thermosetting resin layer 72 permeates into the spaces between the adjacent metal fragments 71*a* in the process of compressing to crack the magnetic metal plates 71.

The thermosetting resin 72*a* filling the spaces between the adjacent metal fragments 71*a* insulates the adjacent metal fragments 71*a*.

Redundant descriptions of other characteristics of the chip electronic component according to an exemplary embodiment in the present disclosure described above, excluding the above description, will be omitted.

As set forth above, according to exemplary embodiments of the present disclosure, a high level of inductance may be secured and an excellent Q factor and DC-bias characteristics may be obtained.

While exemplary embodiments have been shown and described above, it will be apparent to those skilled in the art that modifications and variations could be made without departing from the scope of the present invention as defined by the appended claims.

What is claimed is:

1. A chip electronic component comprising:

a magnetic body including a resin and magnetic metal powder particles dispersed in the resin;

an insulating substrate disposed in the magnetic body;

an internal coil unit disposed on a surface of the insulating substrate, and embedded in and in direct contact with the magnetic body;

a cover unit disposed on at least one of upper and lower surfaces of the magnetic body and including a magnetic metal plate which is cracked and includes a plurality of metal fragments; and an external electrode connected to the internal coil unit, and disposed on a side surface of the magnetic body and a side surface of the cover unit, the external electrode extending from the side surface of the cover unit onto a surface of the cover unit which opposes another surface of the cover unit facing the magnetic body, wherein the magnetic body is in direct contact with the surface of the insulating substrate, and the external electrode is spaced apart from the magnetic metal plate.

2. The chip electronic component of claim 1, wherein spaces between the plurality of adjacent metal fragments are filled with a thermosetting resin.

3. The chip electronic component of claim 1, wherein adjacent metal fragments of the magnetic metal plate have shapes corresponding to each other.

4. The chip electronic component of claim 1, wherein an area of an upper surface or a lower surface of each of the plurality of metal fragments ranges from 0.0001 $\mu m^2$ to 40000 $\mu m^2$.

5. The chip electronic component of claim 1, wherein the plurality of metal fragments have regular shapes.

6. The chip electronic component of claim 1, wherein the plurality of metal fragments have irregular shapes.

7. The chip electronic component of claim 1, wherein the cover unit includes a thermosetting resin layer disposed on at least one of upper and lower surfaces of the magnetic metal plate.

8. The chip electronic component of claim 1, wherein surface roughness of the cover unit is 10 μm or less.

9. The chip electronic component of claim 1, wherein an average thickness of the magnetic metal plate ranges from 5 μm to 30 μm.

10. The chip electronic component of claim 1, wherein a thickness of the cover unit is equal to 5% to 50% of a thickness of the magnetic body.

11. The chip electronic component of claim 1, wherein the magnetic metal plate includes one or more selected from the group consisting of iron (Fe), silicon (Si), boron (B), chromium (Cr), aluminum (Al), copper (Cu), niobium (Nb), and nickel (Ni).

12. The chip electronic component of claim 1, wherein the cover unit includes the magnetic metal plate and a thermosetting resin layer disposed between the magnetic metal plate and the magnetic metal powder particles in the magnetic body, and the thermosetting resin layer is in direct contact with the magnetic body.

13. The chip electronic component of claim 1, wherein the magnetic metal powder particles include first magnetic metal powder particles and second magnetic metal powder particles having average diameter less than that of the first magnetic metal powder particles.

14. The chip electronic component of claim 1, wherein the coil unit includes a first coil unit disposed on the surface of the insulating substrate and a second coil unit disposed on another surface of the insulating substrate opposing the surface of the insulating substrate, and the first and second coil units are connected to each other through a via penetrating through the insulating substrate.

15. The chip electronic component of claim 1, wherein the cover unit includes a plurality of magnetic metal plates.

16. The chip electronic component of claim 15, wherein the cover unit includes a plurality of alternately stacked magnetic metal plates and thermosetting resin layers.

17. The chip electronic component of claim 16, wherein a thickness of each thermosetting resin layer is 1.5 to 2.0 times a thickness of each magnetic metal plate.

18. A chip electronic component comprising:

a magnetic body including a resin and magnetic metal powder particles dispersed in the resin;

an insulating substrate disposed in the magnetic body; and an internal coil unit disposed on a surface of the insulating substrate, and embedded in and in direct contact with in the magnetic body, wherein:

a cover unit is disposed on at least one of upper and lower surfaces of the magnetic body, an external electrode is connected to the internal coil unit and is disposed on a side surface of the magnetic body and a side surface of the cover unit, the external electrode extending from the side surface of the cover unit onto a surface of the cover unit which opposes another surface of the cover unit facing the magnetic body, the cover unit has a magnetic permeability greater than that of the magnetic body, the cover unit includes a magnetic metal plate and a thermosetting resin layer disposed on at least one of upper and lower surfaces of the magnetic metal plate, the magnetic metal plate includes a plurality of metal fragments between which a thermosetting resin is interposed, the magnetic body is in direct contact with the surface of the insulating substrate, and the external electrode is spaced apart from the magnetic metal plate.

19. The chip electronic component of claim 18, wherein the thermosetting resin layer is in direct contact with the magnetic body.

20. A chip electronic component comprising:

a magnetic body including a resin and magnetic metal powder particles dispersed in the resin;

an insulating substrate disposed in the magnetic body;

an internal coil unit disposed on a surface of the insulating substrate, and embedded in and in direct contact with the magnetic body;

a cover unit covering a surface of the magnetic body and including thermosetting resin layers and a magnetic metal plate interposed therebetween; and an external electrode connected to the internal coil unit, and disposed on a side surface of the magnetic body and a side surface of the cover unit, the external electrode extending from the side surface of the cover unit onto a surface of the cover unit which opposes another surface of the cover unit facing the magnetic body, wherein the magnetic metal plate includes a plurality of metal fragments, the magnetic body is in direct contact with the surface of the insulating substrate, and the external electrode is spaced apart from the magnetic metal plate.

21. The chip electronic component of claim 20, wherein an area of an upper surface or a lower surface of each of the plurality of metal fragments ranges from 0.0001 $\mu m^2$ to 40000 $\mu m^2$.

22. The chip electronic component of claim 20, wherein the plurality of metal fragments are arranged in a lattice form.

23. The chip electronic component of claim 20, wherein the plurality of metal fragments have irregular shapes.

24. The chip electronic component of claim 20, wherein a thickness of each thermosetting resin layer is 1.5 to 2.0 times a thickness of the magnetic metal plate.

25. The chip electronic component of claim 20, wherein surface roughness of the cover unit is 10 μm or less.

26. The chip electronic component of claim 20, wherein an average thickness of the magnetic metal plate ranges from 5 μm to 30 μm.

27. The chip electronic component of claim 20, wherein a thickness of the cover unit is equal to 5% to 50% of a thickness of the magnetic body.

28. The chip electronic component of claim 20, the cover unit has a magnetic permeability greater than that of the magnetic body.

29. The chip electronic component of claim 20, wherein one of the thermosetting resin layers is disposed between magnetic metal plate and the magnetic body, and is in direct contact with the magnetic body.

30. The chip electronic component of claim 20, wherein a thermosetting resin is filled between adjacent metal fragments of the magnetic metal plate.

31. The chip electronic component of claim 30, wherein the thermosetting resin filled between the adjacent metal fragments is in direct contact with at least one of the thermosetting resin layers.

32. The chip electronic component of claim 30, wherein the thermosetting resin filled between the adjacent metal fragments directly connects the thermosetting resin layers to each other.

* * * * *